US005937914A

United States Patent [19]

Wilson

[11] Patent Number: 5,937,914

[45] **Date of Patent: *Aug. 17, 1999**

[54] PAPERMAKER'S FABRIC WITH AUXILIARY YARNS

[75] Inventor: Robert G. Wilson, Wake Forest, N.C.

[73] Assignee: Weavexx Corporation, Wake Forest, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/804,138

[22] Filed: Feb. 20, 1997

[51] Int. Cl.[6] ..... D03D 13/00

[52] U.S. Cl. ..... 139/383 A; 162/903

[58] Field of Search ..... 162/903; 139/383 A

[56] References Cited

U.S. PATENT DOCUMENTS

| | | | |
|---|---|---|---|
| Re. 33,195 | 4/1990 | McDonald et al. . | |
| 2,172,430 | 9/1939 | Barrell | 139/383 |
| 2,554,034 | 5/1951 | Koester et al. | 139/426 |
| 3,094,149 | 6/1963 | Keily | 139/383 |
| 4,093,512 | 6/1978 | Fleischer . | |
| 4,182,381 | 1/1980 | Gisbourne . | |
| 4,244,543 | 1/1981 | Ericson . | |
| 4,289,173 | 9/1981 | Miller . | |
| 4,452,284 | 6/1984 | Eckstein et al. . | |
| 4,453,573 | 6/1984 | Thompson . | |
| 4,501,303 | 2/1985 | Osterberg . | |
| 4,515,853 | 5/1985 | Borel . | |
| 4,529,013 | 7/1985 | Miller . | |
| 4,564,052 | 1/1986 | Borel . | |
| 4,592,395 | 6/1986 | Borel . | |
| 4,605,585 | 8/1986 | Johansson . | |
| 4,611,639 | 9/1986 | Bugge . | |
| 4,633,596 | 1/1987 | Josef . | |
| 4,636,426 | 1/1987 | Fleischer . | |
| 4,642,261 | 2/1987 | Fearnhead . | |
| 4,676,278 | 6/1987 | Dutt . | |
| 4,709,732 | 12/1987 | Kinnunen . | |
| 4,729,412 | 3/1988 | Bugge . | |

(List continued on next page.)

FOREIGN PATENT DOCUMENTS

| | | | |
|---|---|---|---|
| 1115177 | 12/1981 | Canada . | |
| 2192729 | 5/1997 | Canada | 139/383 A |
| 0 048 962 | 9/1981 | European Pat. Off. . | |
| 0158 710 | 10/1984 | European Pat. Off. . | |
| 0185 177 | 10/1985 | European Pat. Off. . | |
| 0 224 276 | 12/1986 | European Pat. Off. . | |
| 0264 881 | 10/1987 | European Pat. Off. . | |

(List continued on next page.)

OTHER PUBLICATIONS

Warren, C.A., "The Importance of Yarn Properties in Wet–End Wire Construction," Seminar, The Theory of Water Removal, Dec. 12, 1979.

*Primary Examiner*—Andy Falik
*Attorney, Agent, or Firm*—Myers Bigel Sibley & Sajovec

[57] ABSTRACT

A papermaker's fabric includes a base fabric structure that includes MD yarns and primary CMD yarns interlaced to form a papermaking surface. The papermaker's fabric further includes first and second auxiliary CMD yarns positioned between each pair of adjacent primary CMD yarns. Each first auxiliary CMD yarn has an interlacing pattern relative to the MD yarns that is identical to a first of the pair of adjacent primary CMD yarns, and each second auxiliary CMD yarn has an interlacing pattern relative to the MD yarns that is identical to a second of the pair of adjacent primary CMD yarns. The first auxiliary CMD yarn is positioned between the second primary and auxiliary CMD yarns.

21 Claims, 5 Drawing Sheets

U.S. PATENT DOCUMENTS

| | | | |
|---|---|---|---|
| 4,731,281 | 3/1988 | Fleischer et al. . | |
| 4,739,803 | 4/1988 | Borel . | |
| 4,759,975 | 7/1988 | Sutherland et al. . | |
| 4,815,503 | 3/1989 | Borel . | |
| 4,909,284 | 3/1990 | Kositzke | 139/383 A |
| 4,934,414 | 6/1990 | Borel . | |
| 4,941,514 | 7/1990 | Taipale . | |
| 4,942,077 | 7/1990 | Wendt et al. | 139/383 A |
| 4,945,952 | 8/1990 | Vohringer | 139/383 A |
| 4,967,805 | 11/1990 | Chiu et al. | 139/383 A |
| 4,987,929 | 1/1991 | Wilson . | |
| 4,989,647 | 2/1991 | Marchand . | |
| 4,989,648 | 2/1991 | Tate et al. | 139/383 A |
| 4,998,568 | 3/1991 | Vohringer . | |
| 4,998,569 | 3/1991 | Tate | 139/383 A |
| 5,025,839 | 6/1991 | Wright . | |
| 5,074,339 | 12/1991 | Vohringer . | |
| 5,084,326 | 1/1992 | Vohringer . | |
| 5,092,372 | 3/1992 | Fitzka et al. . | |
| 5,101,866 | 4/1992 | Quigley | 139/383 A |
| 5,116,478 | 5/1992 | Tate et al. . | |
| 5,152,326 | 10/1992 | Vohringer . | |
| 5,158,118 | 10/1992 | Tate et al. . | |
| 5,219,004 | 6/1993 | Chiu . | |
| 5,228,482 | 7/1993 | Fleischer . | |
| 5,358,014 | 10/1994 | Kovar . | |
| 5,421,374 | 6/1995 | Wright . | |
| 5,421,375 | 6/1995 | Praetzel | 139/383 A |
| 5,429,686 | 7/1995 | Chiu et al. | 139/383 |
| 5,454,405 | 10/1995 | Hawes . | |
| 5,456,293 | 10/1995 | Ostermayer et al. | 139/383 A |
| 5,482,567 | 1/1996 | Barreto . | |
| 5,487,414 | 1/1996 | Kuji et al. | 139/383 A |
| 5,518,042 | 5/1996 | Wilson . | |
| 5,520,225 | 5/1996 | Quigley et al. . | |
| 5,542,455 | 8/1996 | Ostermayer et al. | 139/383 A |
| 5,555,917 | 9/1996 | Quigley | 139/383 A |
| 5,564,475 | 10/1996 | Wright . | |
| 5,641,001 | 6/1997 | Wilson . | |
| 5,709,250 | 1/1998 | Ward et al. . | |
| 5,746,257 | 5/1998 | Fry . | |

FOREIGN PATENT DOCUMENTS

| | | |
|---|---|---|
| 0269 070 | 11/1987 | European Pat. Off. . |
| 0 284 575 | 2/1988 | European Pat. Off. . |
| 0 283 181 | 3/1988 | European Pat. Off. . |
| 0 350 673 | 6/1989 | European Pat. Off. . |
| 0 048 849 A2 | 5/1990 | European Pat. Off. . |
| 0 672 782 | 3/1995 | European Pat. Off. . |
| 8605115 | 4/1988 | France . |
| 454 092 | 12/1927 | Germany . |
| 33 29 740 | 3/1985 | Germany . |
| 2-277848 | 11/1990 | Japan . |
| 8-158285 | 12/1994 | Japan . |
| 9-41282 | 7/1995 | Japan . |
| 9-87990 | 9/1995 | Japan . |
| 2245006 | 2/1991 | United Kingdom . |
| WO 86/00099 | 1/1986 | WIPO . |
| WO 89/09848 | 4/1989 | WIPO . |
| WO 93/10304 | 5/1993 | WIPO . |

PAPERMAKER'S FABRIC WITH AUXILIARY YARNS

FIELD OF THE INVENTION

This invention relates generally to woven fabrics, and relates more specifically to woven fabrics for papermakers.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rollers. The belt, often referred to as a "forming fabric", provides a papermaking surface on the upper surface of its upper run, which operates as a filter to separate the cellulosic fibers of the paper stock from the aqueous medium to form a wet paper web. The aqueous medium drains through mesh openings of the forming fabric, known as drainage holes, by gravity or vacuum located on the lower surface (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a drier section for further moisture removal. After drying, the paper is ready for secondary processing and packaging.

Typically, papermakers' fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin seamable flap on each end or a special foldback, then reweaving these into pin seamable loops. In a flat woven papermakers' fabric, the warp yarns extend in the machine direction and the filling yarns extend in the cross machine direction. In the second technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermakers' fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support and an absence of wire marking are important considerations in papermaking, especially for the forming section of the papermaking machine, where the wet web is initially formed. Wire marking is particularly problematic in the formation of fine paper grades, as it affects a host of paper properties, such as sheet mark, porosity, see through, and pin holing. Wire marking is the result of individual cellulosic fibers being oriented within the paper web such that their ends reside within gaps between the individual threads or yarns of the forming fabric. This problem is generally addressed by providing a permeable fabric structure with a co-planar surface which allows paper fibers to bridge adjacent yarns of the fabric rather than penetrate the gaps between yarns. As used herein, "co-planar" means that the upper extremities of the yarns defining the paper forming surface are at substantially the same elevation, such that at that level there is presented a substantially "planar" surface. Accordingly, fine paper grades intended for use in carbonizing, cigarettes, electrical condensers, quality printing, and like grades of fine paper, have typically heretofore been formed on very finely woven or fine wire mesh forming fabrics.

Such finely woven forming fabrics, however, often are delicate and lack dimensional stability in either or both of the machine and cross machine directions (particularly during operation), leading to a short service life for the fabric. In addition, a fine weave may adversely effect drainage properties of the fabric, thus rendering it less suitable as a forming fabric.

One proposed solution for improving forming fabric durability without adversely impacting drainage is offered in U.S. Pat. No. 4,987,929 to Wilson. Wilson describes a papermakers' forming fabric which includes a base fabric layer having single float MD knuckles on the paper contacting surface. Additional fiber supporting CMD yarns are woven into this initial fabric layer; these additional CMD yarns are preferably of smaller diameter than the base fabric layer yarns. The additional fiber supporting CMD yarns are held in place between adjacent fabric layer CMD yarns by additional CMD locator yarns, which are generally of approximately the same diameter as the fiber supporting yarns. This concept is extended in U.S. Pat. No. 5,518,042 to Wilson, in which the additional CMD yarns serve as both locator and support yarns, as they are interwoven so that portions thereof reside on opposite surfaces of the fabric.

One potential shortcoming of these configurations in some fabrics is that, even with the locator yarns in place, the support yarns can shift toward one of the adjacent CMD yarns of the base fabric layer. When such a shift occurs, the gap between the support yarn and the other adjacent CMD yarn increases, so the support yarn can be less successful at providing the requisite "bridge" for cellulosic fibers between adjacent CMD yarns of the base fabric.

SUMMARY OF THE INVENTION

In view of the foregoing, it is an object of the present invention to provide a papermakers' fabric having additional CMD yarns which are reliably and centrally located relative to the primary CMD yarns between which they are located.

It is also an object of the present invention to provide such a fabric configuration that can be used with a variety of fabric weave patterns.

These and other objects are satisfied by the present invention, which includes a papermaker's fabric having additional CMD yarns which are interwoven into a base fabric so as to be reliably and centrally located between adjacent CMD yarns of the base fabric. The papermaker's fabric comprises a base fabric structure that includes MD yarns and primary CMD yarns interlaced to form a papermaking surface. The papermaker's fabric further comprises first and second auxiliary CMD yarns positioned between each pair of adjacent primary CMD yarns. Each first auxiliary CMD yarn has an interlacing pattern relative to the MD yarns that is identical to a first of the pair of adjacent primary CMD yarns, and each second auxiliary CMD yarn has an interlacing pattern relative to the MD yarns that is identical to a second of the pair of adjacent primary CMD yarns. The first auxiliary CMD yarn is positioned between the second primary and auxiliary CMD yarns.

In this configuration, each auxiliary CMD yarn has the same weave pattern as the primary CMD yarn separated from it by only auxiliary CMD yarn. Because of the proximity of the identically-woven primary CMD yarn, the auxiliary CMD yarn is biased toward that primary CMD yarn. At the same time, the adjacent auxiliary CMD yarn is biased in the opposite direction because of its proximity to the adjacent primary CMD yarn. As a result of this opposite biasing, the auxiliary CMD yarns tend to remain centrally located within the gaps of adjacent primary CMD yarns.

This fabric configuration can be used with virtually any base fabric, although it is preferably used with a base fabric having a harness repeat of greater than 2; i.e., the number of primary CMD yarns required to form a repeating unit (the "harness") is greater than 2. Also, it is preferred that the auxiliary CMD yarns be smaller in diameter than the primary CMD yarns to provide a substantially coplanar papermaking surface.

DETAILED DESCRIPTION OF THE INVENTION

The present invention will now be described more particularly hereinafter with reference to the accompanying drawings, in which present embodiments of the invention are shown. The invention, however, be embodied in many different forms and is not limited to the embodiments set forth herein; rather, these embodiments are provided so that the disclosure will fully convey the scope of the invention to those skilled in the art.

The fabric of the present invention is a papermakers' fabric with a specific weave pattern. For ease of understanding of the concepts of the invention, the fabrics illustrated herein will be described as if a base fabric layer were initially woven and then additional yarns added. The hypothetical base fabric layer includes MD yarns and CMD yarns referred to as "primary" CMD yarns. The additional yarns are referred to as "auxiliary" CMD yarns. Of course, the papermakers' fabric of the present invention will typically be woven in a one step weaving process.

Figure 1:
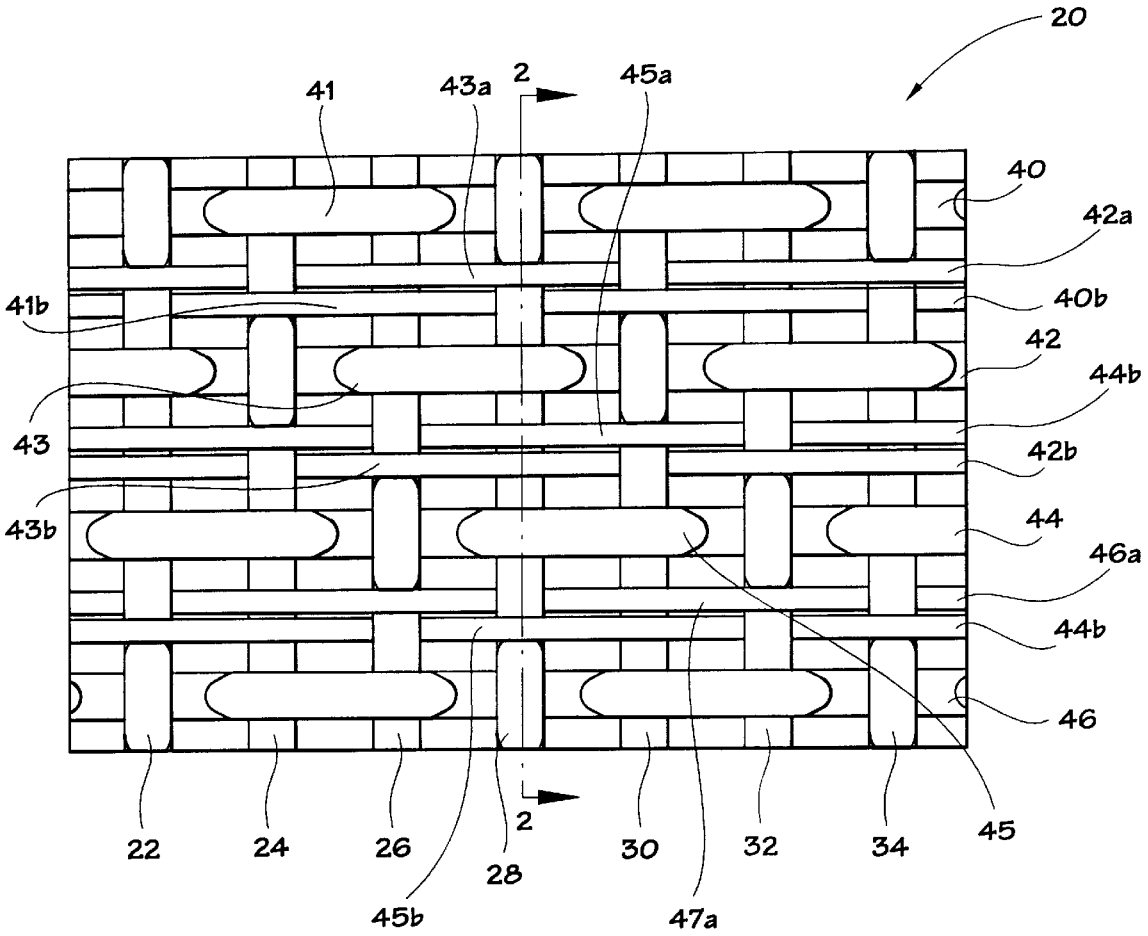
FIG. 1 is a top view of the paper side of a 2×1 twill fabric of the present invention.
Figure 2:
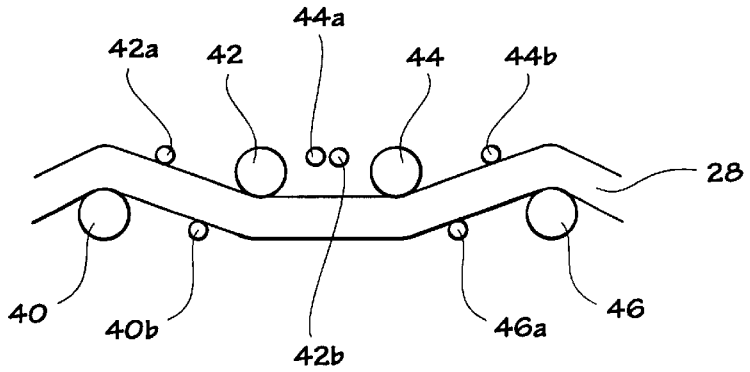
FIG. 2 is a section view taken along lines 2—2 of FIG. 1 showing the interrelationship between a typical MD yarn, primary CMD yarns, and auxiliary CMD yarns.
Figure 3:
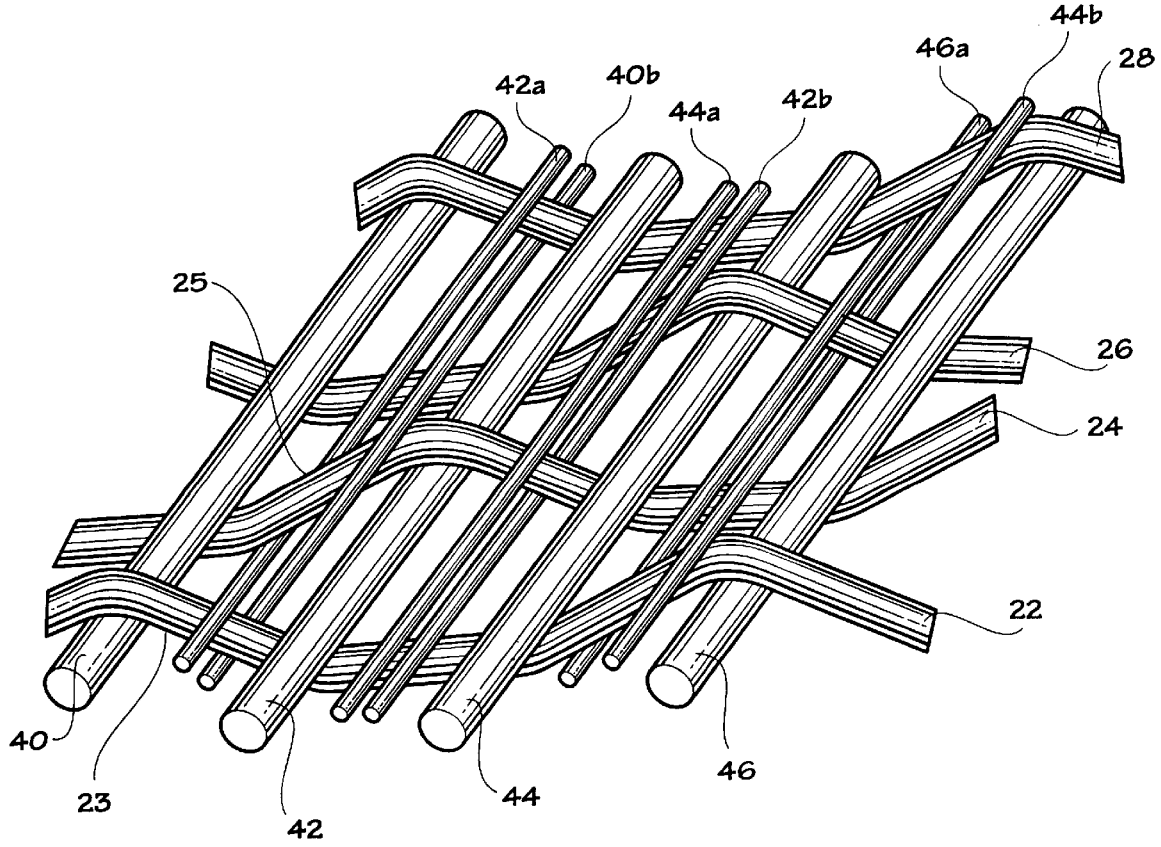
FIG. 3 is an enlarged partial perspective view of the fabric of FIG. 1 showing the interrelationship of auxiliary CMD yarns to one another and to their adjacent primary CMD yarns.

Referring now to the Figures, FIGS. 1 through 3 illustrate a 2×1 twill forming fabric designated broadly at 20. The forming fabric 20 includes MD yarns 22, 24, 26, 28, 30, 32 and 34. These machine direction yarns are interwoven with primary CMD yarns 40, 42, 44 and 46 to form a 2×1 twill fabric. As used herein, and as understood by those skilled in this art, a 2×1 twill is a fabric in which each of the CMD yarns 40, 42, 44 and 46 passes over two adjacent MD yarns, passes beneath the next adjacent MD yarn, then repeats this pattern for subsequent MD yarns along its length. Adjacent CMD yarns follow a similar "over 2-under 1" pattern, but the pattern for each cross machine direction yarn is offset by one MD yarn from its adjacent CMD yarns, such that the MD "knuckles" (locations where an MD yarn passes over a single primary CMD yarn) are also offset in the cross machine direction by one MD yarn for each ensuing primary CMD yarn. The "floats" of the CMD yarns 40, 42, 44, 46 (those portions of the CMD yarns which extend over two MD yarns, two of which are designated at 41 and 43 in FIG. 1) form a "twill" pattern which extends across the fabric 20 at an angle at approximately 45° to the MD yarns.

In addition to the primary cross-machine direction yarns 40, 42, 44 and 46, the forming fabric also includes a pair of auxiliary CMD yarns positioned between each set of adjacent primary CMD yarns. These auxiliary CMD yarns, which are designated in FIGS. 1 and 2 at 40*b*, 42*a*, 42*b*, 44*a*, 44*b* and 46*a*, are interlaced with the MD yarns 22, 24, 26, 28, 30, 32, 34 such that two auxiliary CMD yarns follow the identical weave pattern of each primary CMD yarn relative to the MD yarns. The auxiliary CMD yarns which follow the identical weave pattern of a given primary CMD yarn are those which are positioned between that primary CMD yarn and its adjacent primary CMD yarns, and which have one other auxiliary CMD yarn between them and that primary CMD yarn. For clarity, the auxiliary CMD yarns are identified in FIGS. 1 through 3 with the same component numeral as the primary CMD yarn having the identical weave pattern.

For example, the auxiliary CMD yarns 42*a*, 42*b* have the identical weave pattern as primary CMD yarn 42. The auxiliary CMD yarn 42*a* is positioned between primary CMD yarn 40 and primary CMD yarn 42, and is also located such that the auxiliary CMD yarn 40*b* is positioned between the auxiliary CMD yarn 42*a* and the primary CMD yarn 42. On the opposite side of the primary CMD yarn 42, the auxiliary CMD yarn 42*b* has the identical weave pattern as the primary CMD yarn 42, is positioned between the primary CMD yarn 42 and the primary CMD yarn 44, and is located such that the auxiliary CMD yarn 44*a* is positioned between the auxiliary CMD yarn 42*b* and the primary CMD yarn 42.

This pattern of identical interweaving between primary and auxiliary CMD yarns is maintained for each of the primary CMD yarns; i.e., the weave pattern of primary CMD yarn 44 is identical to that of the auxiliary CMD yarns 44*a* and 44*b*, with the auxiliary CMD yarns 46*a* and 42*b*, respectively, being interposed between the auxiliary CMD yarns 44*a* and 44*b* and the primary CMD yarn 44. The same is true for primary CMD yarns 40 and 46; each has two auxiliary CMD yarns (only one of which is illustrated in FIG. 1 in each case) with the identical weave pattern, and each is separated from its corresponding auxiliary CMD yarns by one interposed auxiliary CMD yarn on each side.

The advantage of this configuration, i.e., having auxiliary CMD yarns matching the weave pattern of a primary CMD yarn but separated therefrom by another auxiliary yarn, is best illustrated in FIG. 3, which shows an enlarged portion of the fabric 20. As illustrated in FIG. 3, MD yarn 22 has a sloping portion 23 which extends from the paper side surface of the fabric 20 downwardly toward the machine side surface as it passes from a position over the primary CMD yarn 40 to a position beneath the primary CMD yarn 42. Similarly, yarn 24 has a sloping portion 25 which slopes upwardly from beneath the primary CMD yarn 40 to a position above the primary CMD yarn 42. Because the auxiliary CMD yarn 40*b* crosses and resides on the sloping portion 25 of MD yarn 24, the auxiliary CMD yarn 40*b* is urged or biased toward primary CMD yarn 40. Conversely, because the auxiliary CMD yarn 42*a* crosses and resides on the sloping portion 23 on machine direction yarn 22, the auxiliary CMD yarn 42*a* is urged or biased toward the primary CMD yarn 42. Thus, each of the auxiliary CMD yarns 40*b,* 42*a* is urged toward the primary CMD yarn that is separated from it by the other auxiliary CMD yarn 42*a,* 40*b.* This opposite biasing of adjacent auxiliary CMD yarns tends to maintain the auxiliary CMD yarns in the center of the gap between adjacent primary CMD yarns rather than permitting the auxiliary CMD yarns to be positioned considerably nearer one primary CMD yarn or the other. As a result, fibers of paperstock should be effectively supported by the centrally-positioned auxiliary CMD yarns.

Another advantage offered by the fabric 20 is the presence of three separate twill lines. One twill line is formed by the floats of adjacent primary CMD yarns, as illustrated in FIG. 1 by floats 41, 43, 45 and so on. Another twill line is formed by the set of auxiliary CMD yarns positioned above their corresponding primary CMD yarns in FIG. 1; these include 43*a,* 45*a,* 47*a,* and so on. The other twill line is formed by the set of auxiliary CMD yarns positioned below their respective corresponding primary CMD yarns in FIG. 1; these are 41*b,* 43*b,* 45*b,* and so on. Thus, every float of every CMD yarn, whether primary or auxiliary, resides within a twill line. This multiplicity of twill lines helps to visually obscure markings of the fabric 20 on paper formed thereon.

Figure 4:
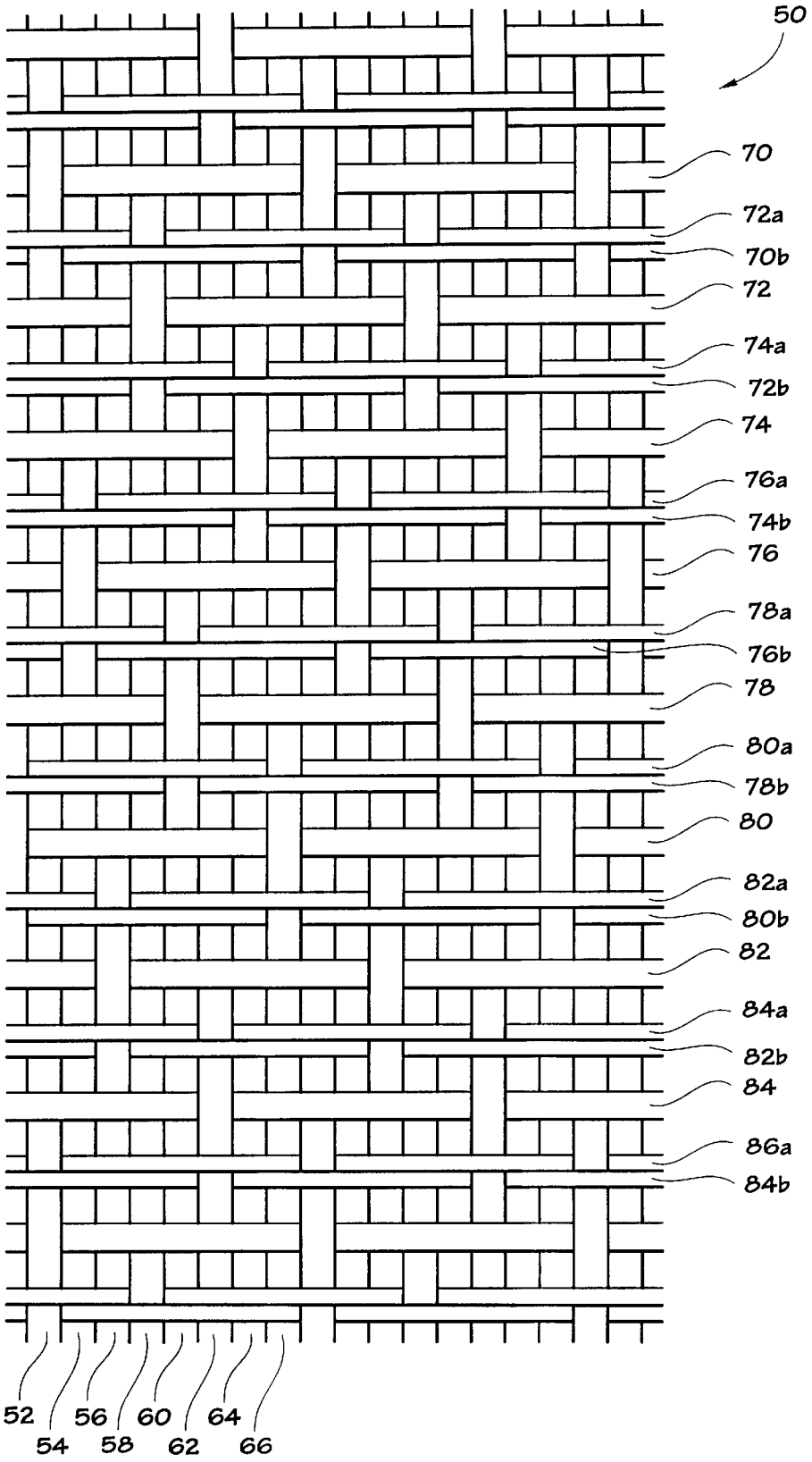
FIG. 4 is a top view of the paper side of an eight harness double-layered fabric of the present invention.
Figure 5:
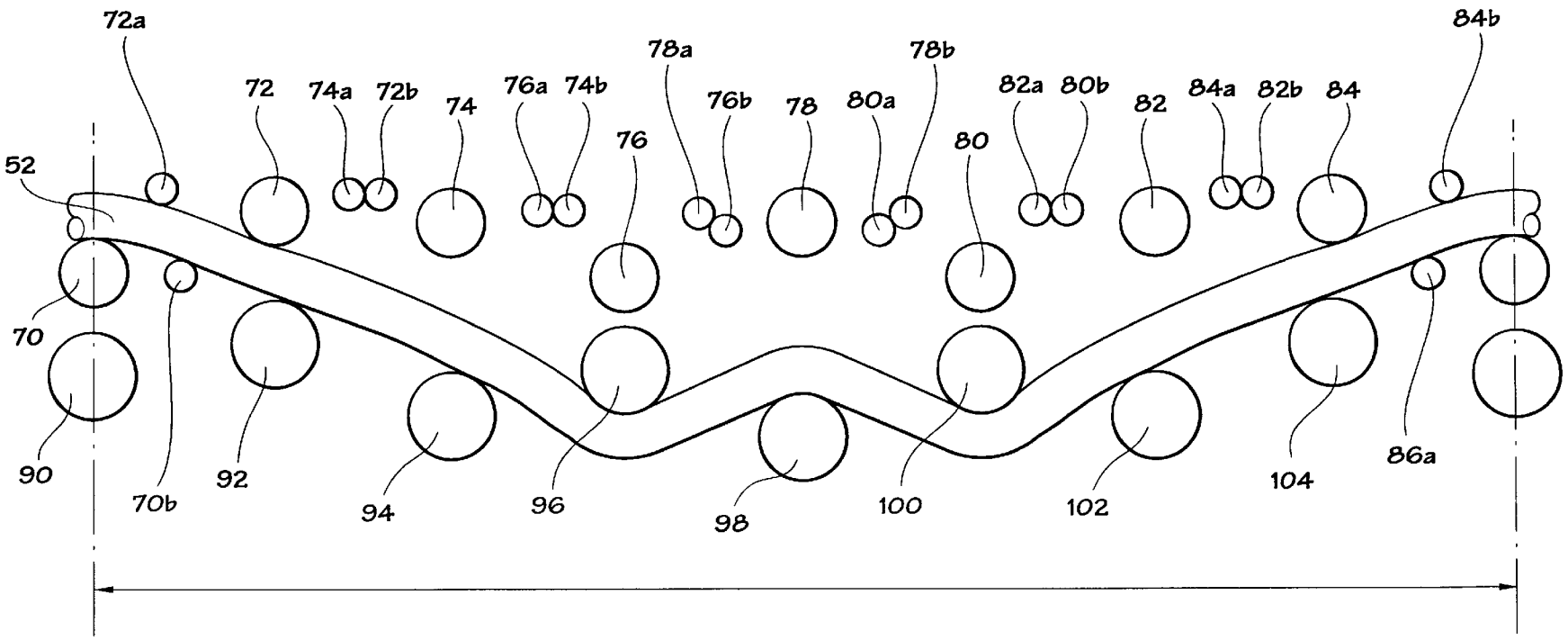
FIG. 5 is a section view taken along lines 5—5 of FIG. 4 showing the interrelationship between an exemplary MD yarn, primary and auxiliary CMD yarns of the fabric layer on the paper side of the fabric, and the CMD yarns of the fabric layer on the machine side of the fabric.

This concept can be utilized with virtually any fabric that includes a pair of auxiliary CMD yarns between each pair of primary CMD yarns. Another exemplary fabric embodying this concept is illustrated in FIGS. 4 and 5, which show an eight harness double-layered fabric 50. In the illustration in FIG. 4 that encompasses its 8×8 repeating unit, the fabric 50 includes MD yarns 52, 54, 56, 58, 60, 62, 64, and 66. Eight primary CMD yarns 70, 72, 74, 76, 78, 80, 82, and 84 are interwoven with the MD yarns in a twill pattern such that each CMD yarn passes over seven MD yarns, passes beneath an MD yarn, then repeats this pattern. Unlike the 2×1 twill fabric 20 of FIGS. 1 through 3, the 8 harness fabric 50 is constructed so that the knuckles adjacent primary CMD yarns are offset in the cross-machine direction by three MD yarns; for example, CMD yarn 70 passes under MD yarn 52, and CMD yarn 72 passes under MD yarn 58.

FIG. 5 illustrates the machine side layer of the base fabric 50 (from which it receives its "double-layered" name). Machine side CMD yarns 90, 92, 94, 96, 98, 100, 102, and 104 are positioned below the primary CMD yarns 70 through 86 described above. A typical CMD yarn 60 is shown passing from the paper side of the fabric 50 to interweave the machine side CMD yarns; specifically, in this instance, the CMD yarn 60 passes over the machine side CMD yarns 90, 92 and 94, under machine side CMD yarn 96, over machine side CMD yarn 98, under machine side CMD yarn 100, and above machine side CMD yarns 102 and 104.

Referring again to FIGS. 4 and 5, a pair of auxiliary CMD yarns is positioned between each pair of primary CMD yarns. As described hereinabove for the 2×1 twill fabric 20, each auxiliary CMD yarn has the identical weave pattern to a primary CMD yarn separated from it by only one other auxiliary CMD yarn. Thus, auxiliary CMD yarn 70*b* has the identical weave pattern to CMD yarn 70, auxiliary CMD yarns 72*a,* 72*b* have the identical weave pattern of CMD yarn 72, and auxiliary CMD yarns 74*a,* 74*b* have the identical weave pattern to primary CMD yarn 74. The same is true for auxiliary CMD yarns 76*a,* 76*b,* 78*a,* 78*b,* 80*a,* 80*b,* 82*a,* 82*b,* 84*a,* 84*b,* and 86*a* each of which has the identical weave pattern as the primary CMD yarn with its corresponding designating number (auxiliary CMD yarn 86*a* has the identical weave pattern to the unlabelled primary CMD adjacent auxiliary CMD yarn 84*b,* which begins the 8 harness repeat unit again). In each instance, the auxiliary CMD yarn is separated from its corresponding primary CMD yarn by one other auxiliary CMD yarn, which, of course, is also separated from its corresponding primary CMD yarn by the first auxiliary CMD yarn.

As illustrated above for the 2×1 twill fabric 20, the positioning of an auxiliary CMD yarn between two primary CMD yarns, one of which has the identical weave pattern, urges that auxiliary CMD yarn toward the primary CMD yarn having the identical weave pattern. However, because there is a second auxiliary CMD yarn is positioned between each auxiliary CMD yarn and its corresponding primary CMD yarn, and the second auxiliary CMD yarn is biased in the opposite direction from its counterpart auxiliary CMD yarn (because it is biased toward its own corresponding primary CMD yarn due to its identical weave pattern), the pairs of auxiliary CMD yarns tend to center one another within the gap between the primary CMD yarns.

As with the 2×1 twill fabric 20, the 8 harness double-layered fabric 50 is also configured such that all of the floats of each primary and auxiliary CMD yarn contribute to the twill line. This twill density can reduce the visual effect of fabric marking on paper produced with the fabric. This concept can be extended to virtually any double layer base fabric, including 7 harness double layer fabrics, the structures of which are well-known to those skilled in this art and need to be described in detail herein.

Figure 6:
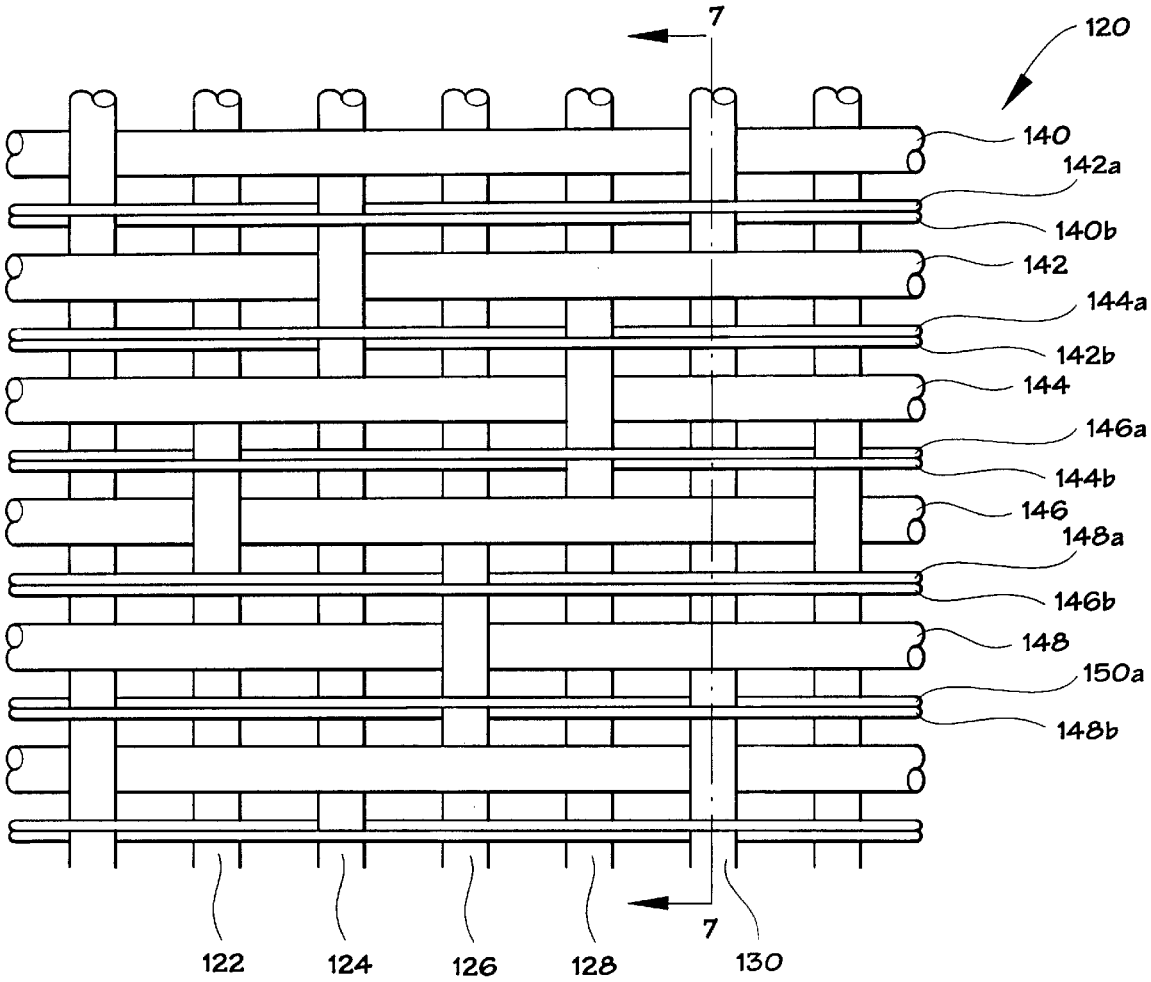
FIG. 6 is a top view of the paper side of a 5 harness satin fabric of the present invention.
Figure 7:
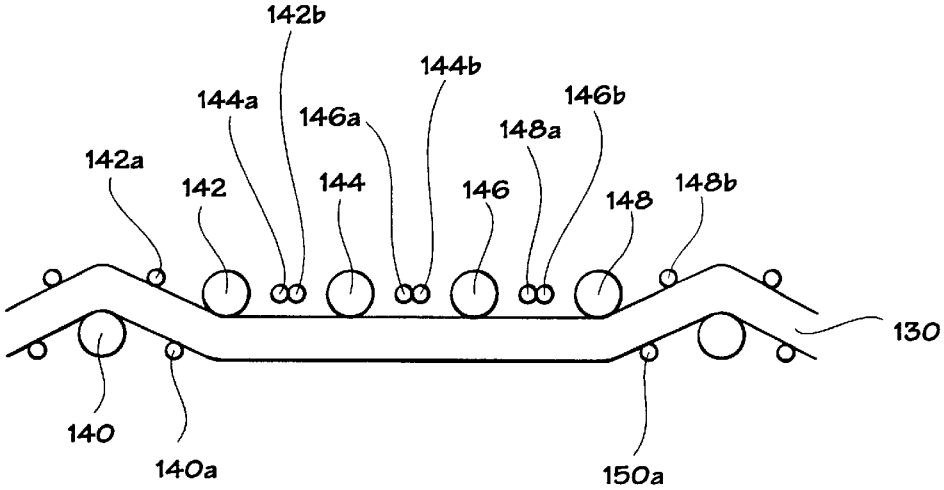
FIG. 7 is a section view taken along lines 7—7 of FIG. 6 showing the interrelationship between an exemplary MD yarn and primary and auxiliary CMD yarns.

A further embodiment of the present invention is shown in FIGS. 6 and 7, in which a five-harness satin fabric 120 is illustrated. The fabric 120 includes machine direction yarns 122, 124, 126, 128, and 130. These are interwoven in a satin pattern (the interweaving details of which are well known by those skilled in the art) with primary CMD yarns 140, 142, 144, 146, and 148. The fabric 120 also includes auxiliary CMD yarns 140*b,* 142*a,* 142*b,* 144*a,* 144*b,* 146*a,* 146*b,* 148*a,* 148*b,* and 150*a.* Each auxiliary CMD yarn is positioned so that it resides between its corresponding CMD primary yarn and an adjacent primary CMD yarn, with another auxiliary CMD yarn interposed therebetween. Also, each auxiliary CMD yarn is interwoven with the MD yarns such that it has the identical weave pattern as its corresponding primary CMD yarn (auxiliary CMD yarn 150 has the identical weave pattern as the primary CMD yarn adjacent auxiliary CMD yarn 148*b,* which begins the 5 harness repeat again).

As with the fabrics 20 and 50 illustrated above, the positioning and weave pattern of these auxiliary CMD yarns relative to their corresponding primary CMD yarns causes each auxiliary CMD yarn to be biased toward its corresponding primary CMD yarn, which in turn tends to center the auxiliary CMD yarn pairs within the gap between adjacent CMD yarns. Of course, the concept can be extended to other satin weave patterns, including 4 harness satin weaves.

Those skilled in this art will appreciate that this concept of auxiliary yarns oppositely biased toward adjacent primary CMD yarns can be applied to virtually any fabric, including plain weaves, twills, satins, and the like. It can be employed as the paper side of single, double and triple layer fabrics, whether interlaced by common MD yarns (such as the fabric 50) or formed as separate fabric layers, such as those described in U.S. Pat. No. 5,277,967 to Zehle. It is preferred that the fabrics of the present invention have a harness repeat of greater than 2.

The form of the yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of cotton, wool, polypropylene, polyester, aramid, nylon, or the like. The skilled artisan should select a yarn material according to the particular application of the final fabric.

Preferably, the auxiliary CMD yarns are of a smaller diameter than the MD and CMD yarns making up the base structure fabric. The size of the smaller diameter auxiliary CMD yarns is typically governed by the size and spacing of the papermaking surface CMD yarns of the base fabric. Generally, the diameter of the auxiliary CMD yarns is about one half the diameter of the primary cross machine direction yarns. Suitable yarn diameters for the yarns of the primary and auxiliary CMD yarns are shown in the following table:

| Primary CMD yarns | | Auxiliary CMD yarns |
|---|---|---|
| Number/Inch | Dia. (mm) | Dia. (mm) |
| 50 | .22 | .104 |
| 45 | .22 | .105 |
| 40 | .22 | .106 |
| 35 | .22 | .107 |
| 30 | .22 | .108 |
| 40 | .23 | .101 |
| 40 | .24 | .115 |
| 40 | .25 | .120 |
| 40 | .26 | .124 |

The foregoing embodiments are illustrative of the present invention, and are not to be construed as limiting thereof. The invention is defined by the following claims, with equivalents of the claims to be included therein.

That which is claimed is:

1. A papermaker's fabric, comprising:

a base fabric structure including machine direction yarns and primary cross machine direction yarns interlacing to form a papermaking surface, said machine direction yarns and primary cross machine direction yarns being interlaced in a pattern having a harness repeat of greater than two;

first and second auxiliary cross machine direction yarns positioned between each pair of adjacent primary cross machine direction yarns;

wherein each first auxiliary cross machine direction yarn has an interlacing pattern relative to said machine direction yarns that is identical to a first of said pair of adjacent primary cross machine direction yarns, and wherein each second auxiliary cross machine direction yarn has an interlacing pattern relative to said machine direction yarns that is identical to a second of said pair of adjacent primary cross machine direction yarns, and wherein said first auxiliary cross machine direction yarn is positioned between said second primary and auxiliary cross machine direction yarns.

2. The papermaker's fabric defined in claim 1, wherein said second auxiliary cross machine direction yarn is positioned between said first primary and auxiliary cross machine direction yarns.

3. The papermaker's fabric defined in claim 1, wherein said repeating harness pattern is a twill pattern.

4. The papermaker's fabric defined in claim 3, wherein said twill pattern is a 2×1 twill.

5. The papermaker's fabric defined in claim 1, wherein said repeating harness pattern is a satin pattern.

6. The papermaker's fabric defined in claim 5, where said satin pattern is a five harness satin.

7. The papermaker's fabric defined in claim 1, wherein primary cross machine direction yarns have a first diameter, and said auxiliary cross machine direction yarns have a second diameter that is smaller than said first diameter.

8. The papermaker's fabric defined in claim 1, further comprising additional cross machine direction yarns interlaced with said machine direction yarns to form a machine side surface.

9. The papermaker's fabric defined in claim 8, wherein said base fabric is selected from the group consisting of a 7 and 8 harness double layer fabric.

10. A papermaker's fabric, comprising:

a base fabric structure including machine direction yarns and primary cross machine direction yarns interlacing to form a papermaking surface, said machine direction yarns and primary cross machine direction yarns being interlaced in a repeating harness pattern, said primary cross machine direction yarns having a first diameter;

first and second auxiliary cross machine direction yarns positioned between each pair of adjacent primary cross machine direction yarns, each of said auxiliary cross machine direction yarns having a second diameter that is less than said first diameter;

wherein each first auxiliary cross machine direction yarn has an interlacing pattern relative to said machine direction yarns that is identical to a first of said pair of adjacent primary cross machine direction yarns, and wherein each second auxiliary cross machine direction yarn has an interlacing pattern relative to said machine direction yarns that is identical to a second of said pair of adjacent primary cross machine direction yarns, and wherein said first auxiliary cross machine direction yarn is positioned between said second primary and auxiliary cross machine direction yarns.

11. The papermaker's fabric defined in claim 10, wherein said second auxiliary cross machine direction yarn is positioned between said first primary and auxiliary cross machine direction yarns.

12. The papermaker's fabric defined in claim 10, wherein said repeating harness pattern is a twill pattern.

13. The papermaker's fabric defined in claim 12, wherein said twill pattern is a 2×1 twill.

14. The papermaker's fabric defined in claim 10, wherein said repeating harness pattern is a satin pattern.

15. The papermaker's fabric defined in claim 14, where said satin pattern is a five harness satin.

16. The papermaker's fabric defined in claim 10, further comprising additional cross machine direction yarns interlaced with said machine direction yarns to form a machine side surface.

17. The papermaker's fabric defined in claim 16, wherein said base fabric is selected from the group consisting of a 7 and 8 harness double layer fabric.

18. A method of making paper, comprising the steps of:

providing a papermaker's fabric, said papermaker's fabric comprising:

a base fabric structure including machine direction yarns and primary cross machine direction yarns interlacing to form a papermaking surface, said machine direction yarns and primary cross machine direction yarns being interlaced in a pattern having a harness repeat of greater than 2;

two auxiliary cross machine direction yarns positioned between each pair of adjacent primary cross machine direction yarns;

wherein each first auxiliary cross machine direction yarn has an interlacing pattern relative to said machine direction yarns that is identical to a first of said pair of adjacent primary cross machine direction yarns, and wherein each second auxiliary cross machine direction yarn has an interlacing pattern relative to said machine direction yarns that is identical to a second of said pair of adjacent primary cross machine direction yarns, and wherein said first auxiliary cross machine direction yarn is positioned between said second primary and auxiliary cross machine direction yarns;

applying paper stock to said papermaker's fabric; and removing moisture from said paper stock.

19. The method defined in claim 18, wherein said fabric is woven in a twill pattern.

20. The method defined in claim 18, wherein said fabric is woven in a satin pattern.

21. The method defined in claim 18, wherein said fabric includes additional cross machine direction yarns that form a machine side surface.

* * * * *